United States Patent [19]

Gramling William D.

[11] Patent Number: 4,712,981

[45] Date of Patent: Dec. 15, 1987

[54] PRESSURE-OPERATED VALVING FOR OIL AND GAS WELL SWABS

[76] Inventor: Gramling William D., 5144 Newport Ave., Chevy Chase, Md. 20816

[21] Appl. No.: 924,417

[22] Filed: Oct. 29, 1986

Related U.S. Application Data

[63] Continuation-in-part of Ser. No. 832,445, Feb. 24, 1986, abandoned.

[51] Int. Cl.[4] ..... F04B 47/12

[52] U.S. Cl. ..... 417/56

[58] Field of Search ..... 417/56, 57, 58, 59, 417/60

[56] References Cited

U.S. PATENT DOCUMENTS

| | | | |
|---|---|---|---|
| 2,212,416 | 8/1940 | Eddins | 417/60 |
| 3,176,619 | 4/1965 | Shaw | 417/60 |
| 4,070,134 | 1/1978 | Gramling | 417/56 |

*Primary Examiner*—Leonard E. Smith

[57] ABSTRACT

Apparatus and method of utilizing differential pressure to seat an almost-closed valve ball. Included are apparatus and means to protect valve ball from excessive closing force. Also included is a multiple valve arrangement to relieve excessive differential pressure.

12 Claims, 6 Drawing Figures

PRESSURE-OPERATED VALVING FOR OIL AND GAS WELL SWABS

RELATED APPLICATIONS

This is a continuation-in-part application of application Ser. No. 832,445, filed Feb. 24, 1986, now abandoned.

FIELD OF THE INVENTION

Gas and oil well swabs, particularly internal valving of pneumatically-operated valving in swabs as described in the teachings of U.S. Pat. No. 4,070,134, the valve being closed solely by the movement of a piston sliding inside a cylinder. No auxiliary actuating apparatus is utilized. In the event the valve ball is seated and pressure surrounding the pneumatic cylinder continues to build, the piston exerts excessive force on the valve ball, damaging the ball.

SUMMARY OF THE INVENTION

Apparatus and method for closing an almost-closed valve ball by providing a resilient coupling between the ball and the actuating rod. The increased pressure caused by the restriction of the flow of liquids through the almost-closed valve acts on the bottom of the valve ball, seating it onto the valve seat against the resiliency of the coupling. If the valve is fully closed but pressure continues to build around the pneumatic closing device, the resiliency of the coupling allows the piston rod to separate from the ball, relieving damaging pressure on the ball. Apparatus and method for relieving excessive pressure under the valve ball.

DESCRIPTION OF THE PREFERRED EMBODIMENTS

Figure 1:
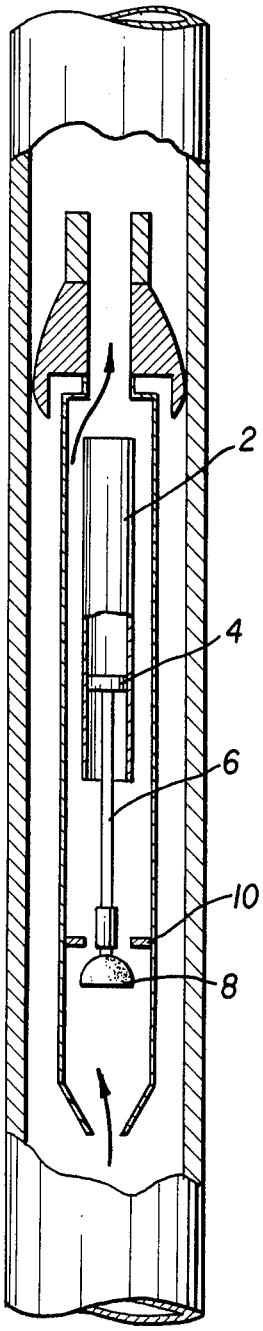
FIG. 1 shows the pneumatically-operated swab for oil and gas wells.

The basic automatic swab, described in U.S. Pat. No. 4,070,134 and basically illustrated in FIG. 1, uses a pneumatic tube 2 and piston 4 actuated by changes in head pressure as the device sinks deeper in the oil, pulls a valve ball 8 hard-coupled to a piston rod 6 against a valve seat 10. The seating of the valve ball effectively shuts off the flow of natural gas through the swab. Consequently, the increasing gas pressure under the swab lifts it and its oil load to the surface.

This arrangement worked satisfactorily for the most part. However, a condition arises when the valve ball is almost closed, being about ⅛ inch from the seat. This restriction builds a slight pressure under the swab. This three or four pounds of pressure is sufficient to suspend the swab, stopping its descent. Since no more oil passes upward through the swab, the head pressure remains constant, the valve ball 8 never seats, and the swab stops indefinitely.

Figure 2:
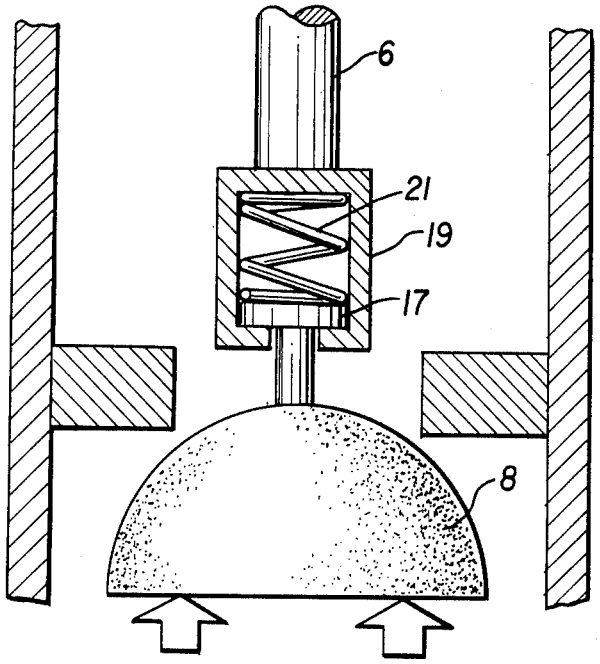
FIG. 2 is the valve ball in an almost-closed position, before the differential pressure seats it.
Figure 3:
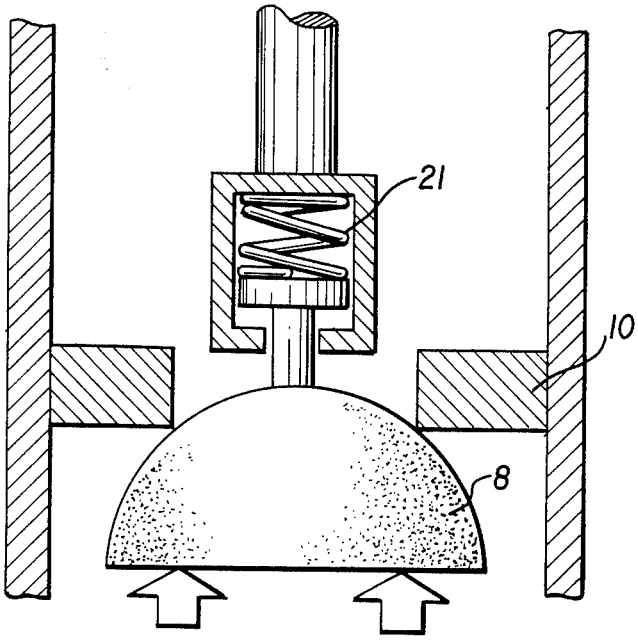
FIG. 3 illustrates the present invention after the differential pressure has seated the valve ball.

The first portion of the present invention as presented in FIG. 2 connects the valve ball 8 to the piston rod 6 through a mechanism comprising a piston 17, slideable in a cylinder enclosure 19 and lightly held downward by a compression spring 21. The arrows under the ball valve indicate pressure building from the restriction of the flow of gas. In FIG. 3, the pressure has risen to a point where it has pushed the ball valve 8 against the valve seat 10 compressing the spring 21. The swab is now effectively sealed.

Figure 4:
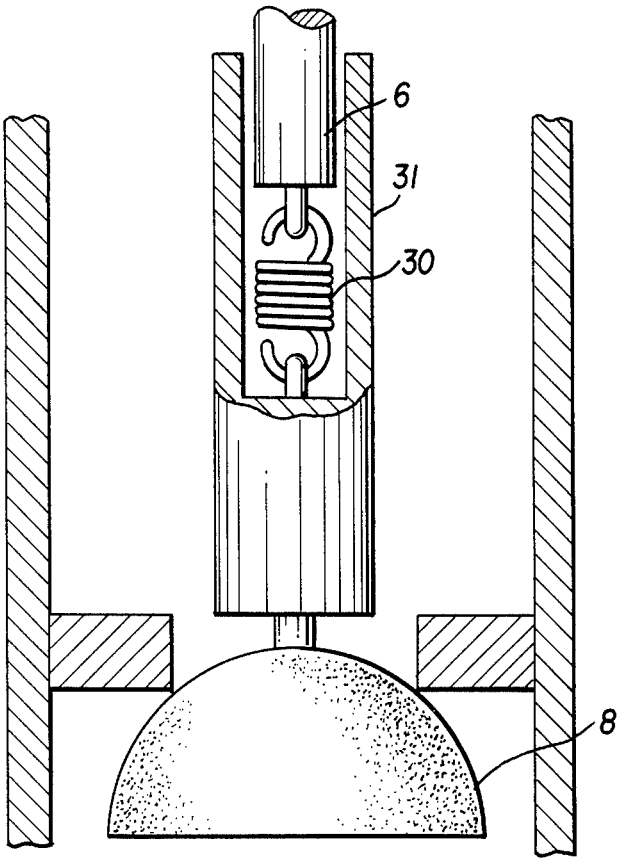
FIG. 4 represents the addition of the relaxed valve ball tension relief mechanism.
Figure 5:
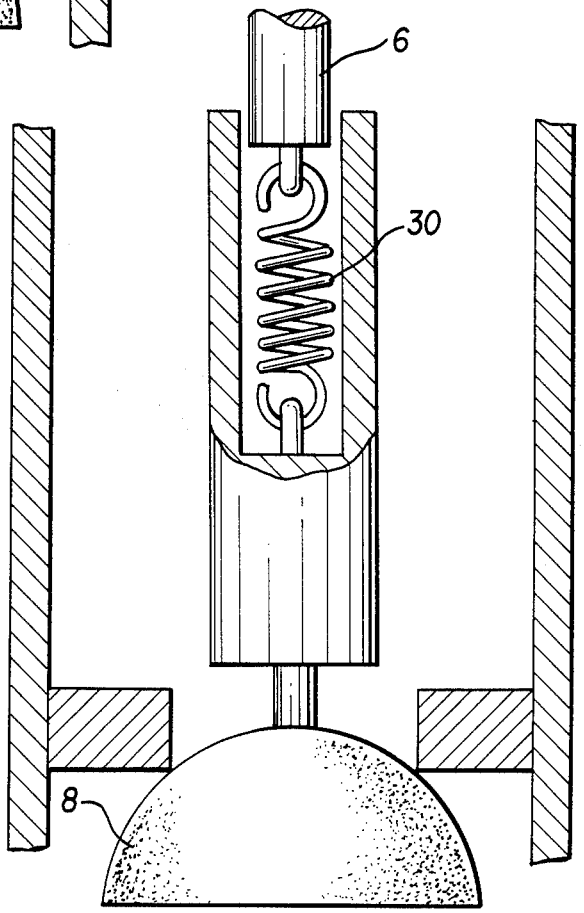
FIG. 5 is the relief mechanism in the actuated mode.

Another situation can occur wherein the swab valve has closed but, due to a torn external seal or the shutting in of the well, pressure acting on the pneumatic tube continues to rise. The piston rod pulls increasingly harder on the valve ball and eventually the ball becomes distorted and useless. In FIG. 4, the valve ball 8 is coupled to the piston rod 6 by the mechanism shown in FIGS. 2 and 3, and additionally through an expansion spring 30 connected to the cylindrical enclosure 31 and the bottom of the piston rod 6. FIG. 4 shows the connection in a normal, relaxed state. In FIG. 5, the piston rod 6 is being pulled upward by the pneumatic cylinder by excessive head pressure. Since the valve ball 8 is seated and cannot move, the strain is relieved by the expansion of the spring 30. When the head pressure returns to normal, the piston rod 6 moves downward, relaxing the spring 30 to its normal state shown in FIG. 4.

Figure 6:
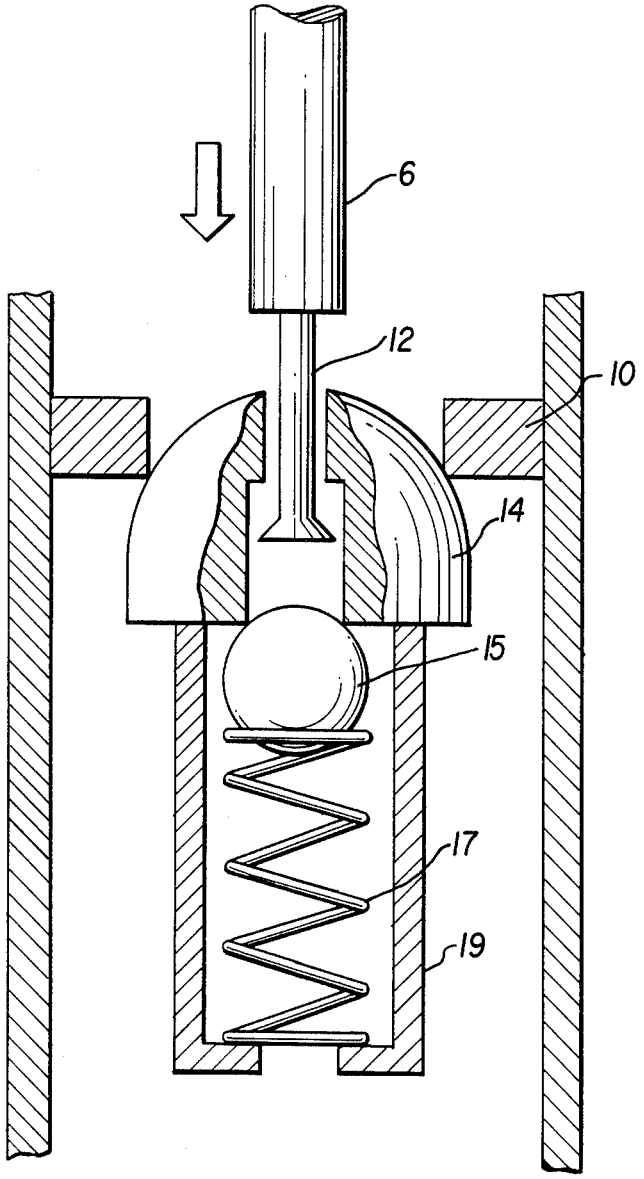
FIG. 6 shows the configuration of an additional small valve ball and seat mounted onto the primary valve ball.

A condition arises wherein excessive gas pressure builds under the valve ball. When this happens, the pneumatic tube 2 and piston 4, in FIG. 1, pushing on rod 6 is unable to unseat the valve ball 8. The pressure continues to build, stopping the operation of the swab and creating a dangerous condition. Referring to FIG. 6, a passageway is placed through the primary valve ball 14. A smaller secondary valve ball 15 is mounted beneath the primary valve ball 14 and is held against the bottom end of the passageway by the spring 17 contained in the cage 19.

When the actuating rod 6 moves downward to unseat the primary valve ball 14, the pin 12 first contacts the secondary valve ball 15 and unseats it. The pressure is then exhausted upward through the passageway in the primary valve ball 14. When the pressure is sufficiently reduced, the rod 6 can then unseat the primary valve ball 14.

The ball assembly hands on the flange of the pin 12 contacting the shoulders on the upper part of the passageway. The space between the pin 12 and the valve ball 15 allows the primary valve ball 14 to move upward from an almost-closed to a closed position as described earlier.

Having disclosed my invention, what I claim as new and to be secured by Letters Patent of the United States is:

1. In a swabbing device for pumping liquids from oil wells and other like wells, a connection member between the valve ball and the activating means for the valve ball, the connection member comprising:

a rod extending downwardly from said actuating means and coupling means disposed between the end of said rod and said valve ball which permits limited axial movement of said valve ball relative to said rod in response to fluid pressure acting upwardly on said valve ball.

2. A connection member in accordance with claim 1 wherein said coupling means includes resilient means urging said valve ball in a downward direction.

3. A connection member in accordance with claim 2 wherein said resilient means comprises a weak compression spring.

4. A connection member in accordance with claim 1 wherein said actuating means comprises a piston and cylinder assembly.

5. A connection member in accordance with claim 1 wherein said coupling means further includes means for permitting limited upward movement of said actuating means relative to said valve ball when said valve ball is seated, said coupling means comprising a resilient member opposing said upward movement.

6. In a swabbing device for pumping liquids from oil wells and other like wells, a connection member between the valve ball and the actuating means for the valve ball, the connection member comprising a rod extending downwardly from said actuating means and coupling means between the lower part of said rod and said valve ball which permits limited axial movement of said actuating means relative to said valve ball when the latter is seated, said coupling means including a resilient member which urges said actuating means towards said valve ball and resiliently opposes the upward movement of said rod relative to said valve ball when the latter is seated.

7. A connection member in accordance with claim 6 wherein said resilient member comprises a tension spring.

8. A connection member in accordance with claim 6 wherein said actuating means comprises a piston and cylinder assembly.

9. In a swabbing device for pumping liquids from oil wells and other like wells, a connection member between the valve ball and the activating means for the valve ball, the connection member comprising:

vertically disposed fluid passage means which defines a conduit through said valve ball, a rod extending downwardly from said actuating means into said passage means, said rod and said valve ball being coupled in an arrangement that permits limited vertical movement by said rod relative to said valve ball, pressure relief means in said fluid passage means which is associated with said rod in an arrangement that when said rod moves sufficiently downwardly relative to said valve ball, said pressure relief means is opened so that fluid pressure under said valve ball is relieved to space above said valve ball.

10. A connection member in accordance with claim 9 wherein said relief means that comprises a further valve ball and the lower aspect of said first mentioned valve ball comprises a valve seat for said further valve ball.

11. A connection member in accordance with claim 10 wherein a compression spring is supported from said first mentioned valve ball which urges said further valve ball against said valve seat.

12. A connection member in accordance with claim 9 wherein said passage means that comprises a shoulder in the upper aspect thereof and the lower aspect of said rod comprises a corresponding shoulder which cooperates with first mentioned said shoulder to support said valve ball from said rod.

* * * * *